US005242091A

United States Patent [19]

Ishida et al.

[11] Patent Number: 5,242,091

[45] Date of Patent: Sep. 7, 1993

[54] SEALANT CARTRIDGE

[75] Inventors: Nobuo Ishida, Chiba; Katsumi Takane, Fukui, both of Japan

[73] Assignee: Dow Corning Toray Silicone Co., Ltd., Tokyo, Japan

[21] Appl. No.: 979,089

[22] Filed: Nov. 19, 1992

[30] Foreign Application Priority Data

Nov. 21, 1991 [JP] Japan ..... 3-332522

[51] Int. Cl.[5] ..... B65B 7/00

[52] U.S. Cl. ..... 222/386

[58] Field of Search ..... 222/326, 327, 386, 389; 277/72 FM, 136, DIG. 6

[56] References Cited

U.S. PATENT DOCUMENTS

| | | | |
|---|---|---|---|
| 2,093,386 | 9/1937 | Tear | 222/386 X |
| 3,442,424 | 5/1969 | Prussin et al. | 222/389 X |
| 4,134,523 | 1/1979 | Hansen et al. | 222/389 |
| 4,579,259 | 4/1986 | Hirao et al. | 222/389 |
| 4,854,485 | 8/1989 | Collins | 222/386 |
| 5,056,690 | 10/1991 | Ichihara et al. | 222/386 |
| 5,065,900 | 11/1991 | Scheindel | 222/386 X |
| 5,133,485 | 7/1992 | Ohno | 222/386 |

FOREIGN PATENT DOCUMENTS

| | | | |
|---|---|---|---|
| 59187 | 12/1989 | Japan | 222/327 |

*Primary Examiner*—Kevin P. Shaver
*Attorney, Agent, or Firm*—Arne R. Jarnholm

[57] ABSTRACT

The sealant cartridge of the invention utilizes a specially designed plunger in a standard cartridge body for storing and dispensing air-curable sealants. The plunger has a plurality of grooves formed in its circumferential surface. With the plunger removed, the cartridge body can be filled with sealant through its open end. When the plunger is inserted into the open end of the cartridge body, air that is entrapped between the plunger and sealant escapes through the grooves and sealant is then extruded therethrough. The sealant in the grooves cures, protecting the sealant stored in the cartridge from contact with the atmosphere.

9 Claims, 1 Drawing Sheet

SEALANT CARTRIDGE

BACKGROUND OF THE INVENTION

1. Field of the Invention

The present invention relates generally to cartridge devices adapted for storing and dispensing air-curable viscous fluids, such as caulking compounds, sealing compounds and the like. More particularly, the present invention relates to a substantially airtight cartridge that includes a novel plunger adapted for inserting in the back end of the cartridge body, without taking in or trapping air.

2. Description of the Prior Art

Sealing compounds and the like that cure under the effect of atmospheric moisture (e.g., silicone sealants, polyurethane sealants, polysulfide sealants, etc.) are in wide use in the fields of civil engineering and construction. Examples include the waterproof sealing of window frames, joints, and so forth. While those skilled in the art will recognize that the present invention is useful for storing and dispensing all such viscous fluids, for the sake of simplicity the term "sealant" is use herein to describe such viscous fluids.

Sealant cartridges generally comprise: a tubular cartridge body in which the sealant is disposed; a discharge element such as a nozzle at one end of the cartridge body; and a cylindrical plunger, which is adapted for being received in the other end of the tubular cartridge body and which is axially slidable therein so as to permit the sealant to be extruded from the discharge element. The prior art describes various types of substantially airtight sealant cartridges which isolate the sealant therein from atmospheric moisture and thus secure long-term storage stability. Examples of the prior art include: a sealant cartridge that is characterized by the application of a flame-coated film of ceramic or metal on the circumference of the plunger (Japanese Utility Model Application Laid-Open [Kokai or Unexamined] Number 59-19569 [19,569/1984]); a sealant cartridge that is characterized by the application of a paint sealing film on the rear interior surface of the cartridge body or on the circumference of the plunger (Japanese Patent Application Laid-Open Number 60-68272 [68,272/1985]); and a sealant cartridge that is characterized by the application of a wax-based sealing agent to the rear interior surface of the cartridge body and by the installation of a ringshaped projection along the circumference of the cartridge body in part of the aforesaid sealing agent (Japanese Patent Application Laid-Open Number 63-67276 [67,276/1988]).

As used herein the term "sealing agent" refers not to the sealant disposed in the cartridge and dispensed therefrom but to a compound or mixture which prevents air leakage to the sealant at the interior wall of the cartridge body and the circumferential surface of the plunger.

The prior art sealant cartridges still suffer from the particular deficiency that the sealant at the end of the cartridge associated with the plunger cures during long-term storage. This occurs because air is trapped at that end of the cartridge body when the plunger is inserted therein, after the sealant has been filled into the cartridge body. To counter this, the filling process must be supplemented with a separate process that removes the residual air trapped at the rear of the cartridge body, but such a measure impairs the productivity of the filling operation.

The present invention overcomes the drawbacks of the prior art by providing a sealant cartridge wherein the plunger can be inserted into a sealant-filled cartridge body without taking in or trapping air.

SUMMARY OF THE INVENTION

The sealant cartridge of the invention comprises: a tubular cartridge body having a closed end and an open end and which is adapted for receiving a sealant therein; a discharge element such as a nozzle at the closed end of the cartridge body; and a cylindrical plunger, which is adapted for being received in the open end of the tubular cartridge body and which is axially slidable therein so as to permit the sealant to be extruded from the discharge element. The plunger has at least one and preferably a plurality of substantially linear grooves formed in its circumferential surface, which grooves are substantially axially aligned with the tubular cartridge body.

With the plunger removed, the cartridge body can be filled with sealant through the open end, opposite the discharge element. When the plunger is inserted into the open end of the cartridge body, air that is entrapped between the plunger and sealant escapes through the grooves and sealant is then extruded therethrough. This sealant in the grooves cures, protecting the sealant stored in the cartridge from contact with the atmosphere.

A sealing agent, such as a wax-like material is used to ensure that an air tight seal is maintained between circumferential surface of the plunger and the interior wall of the tubular cartridge body.

DETAILED DESCRIPTION OF THE INVENTION

Figure 1:
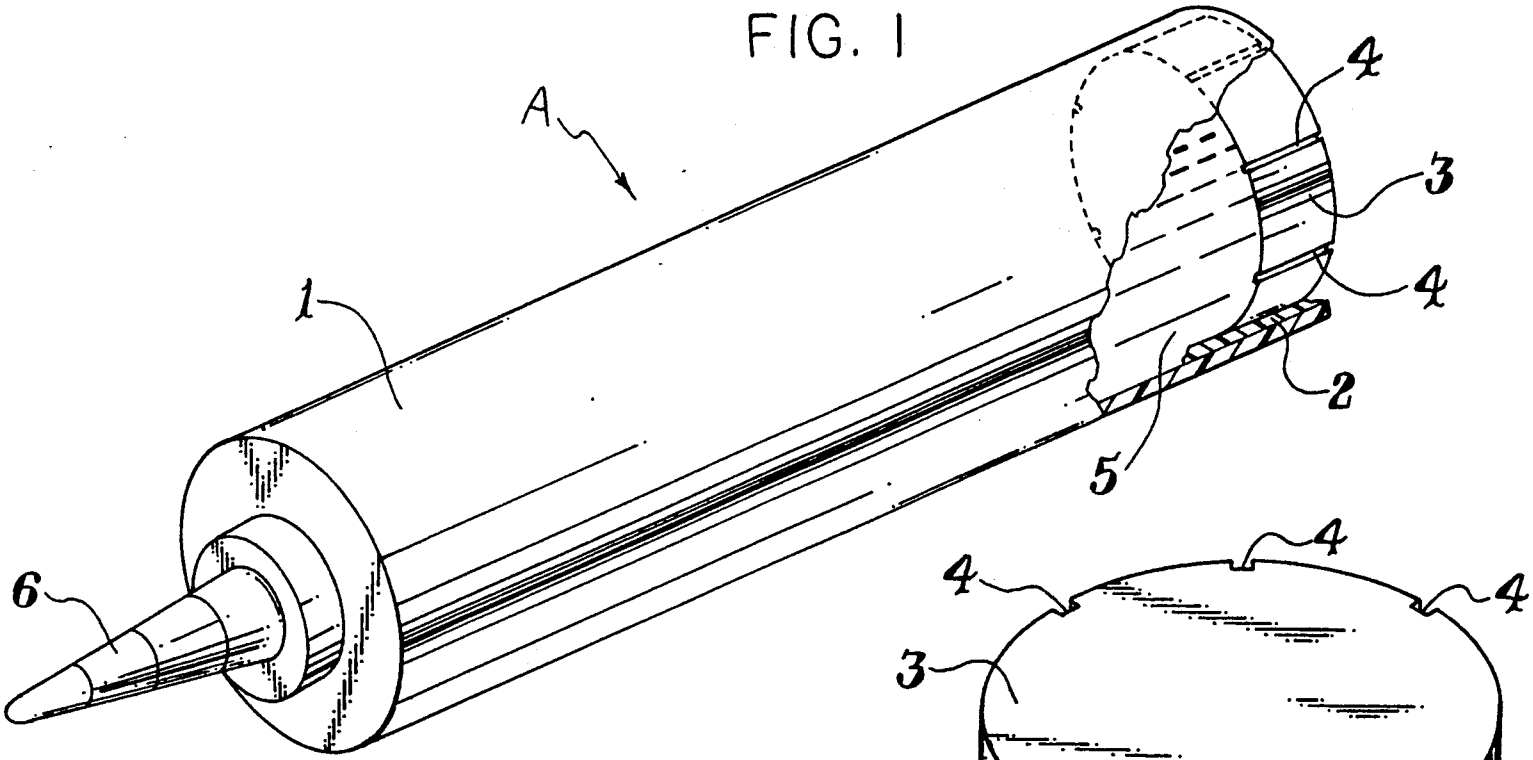
FIG. 1 is a perspective view of a sealant-filled cartridge of the invention with a break-away section at the rear portion of the cartridge body so as to illustrate the novel geometry and location of the plunger and the location of the sealing agent.

Referring now to FIG. 1 it can be seen that the cartridge of the invention, generally indicated at A, includes: a tubular cartridge body 1, which is closed at one end; a discharge element 6 mounted at the closed end; a plunger 3 adapted for being received in the other, open end of the tubular cartridge body 1 and which is axially slidable therein; and a sealing agent 2 which is disposed between the plunger 4 and interior surface of the cartridge body 1.

The cartridge body 1 is made of a material that is both airtight and capable of retaining its shape. Such materials include plastics that have very low gas permeabilities, for example, high-density polyethylene, high-density polypropylene, and paper that is coated with such a plastic or with aluminum foil.

The discharge element 6 is installed at the closed end cartridge body 1 and is preferably a nozzle that has been integrally molded with the cartridge body 1. In such case the nozzle must be opened or cut away to provide an orifice for the discharge of sealant 5. The discharge element 6 or nozzle may also be affixed by a threaded element adapted for the mounting of a separately molded nozzle. The other end of the cartridge body 1 presents an opening or orifice that permits the cartridge body 1 to be filled with sealant 5.

The sealing agent 2 is used to ensure an air tight seal between the interior wall of the cartridge body 1 and the circumferential surface of the plunger 4. The sealing agent material should have a low gas permeability and should not contaminate the sealant fill. Examples of such materials are high-viscosity mineral and synthetic oils, mineral oil greases, synthetic greases, synthetic waxes (e.g., long-chain alkyl-modified polysiloxane waxes, polyethylene-based microcrystalline waxes, etc.), petroleum waxes, vegetable waxes, animal waxes, mixtures composed of these waxes and high-viscosity polymer (e.g., highviscosity polybutenes or polyisobutylenes, etc.), and so forth.

Among the preceding, preferred sealing agents 2 are composed of a wax as described above plus a high-viscosity polymer (e.g., high-viscosity polybutenes and polyisobutylenes), are very thick plastic materials in the vicinity of room temperature, and become fluid upon heating at or above the melting point of the wax. These sealing agents are preferred because they provide a smooth plunger motion and have an excellent ability to accompany or follow the sliding motion of the plunger 3.

The sealing agent 2 is preferably preliminarily coated as a strip or line on the interior surface of the cartridge body 1 at the open end. The coating width and coating quantity of the sealing agent are not particularly restricted, and these parameters should be selected as appropriate in order to give conditions that will maintain the airtightness of the sealant cartridge.

Figure 2:
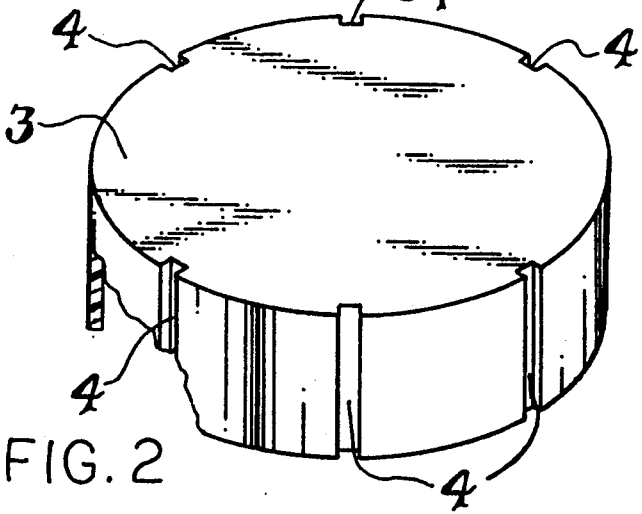
FIG. 2 is an enlarged perspective view of the plunger of the invention showing the grooves formed in the plunger's circumferential surface and having a partial break-away section to illustrate the construction of the plunger.

Referring now to both FIGS. 1 and 2, it can be seen that the plunger 3 of the present invention possesses a unique geometry. The plunger 3 is generally a disk- or cylindrically-shaped element adapted for insertion into the open end of the cartridge body 1 after the sealant filling operation. The airtightness of the sealant cartridge A is maintained by contact between the interior wall of the cartridge body 1 and the circumferential surface of the plunger 3 and the use of a sealing agent 2, as described above.

To use the sealant cartridge of the invention A, the sealant 5 is gradually extruded in suitable quantities from the discharge element 6 by moving the plunger 3 by pressing the back surface of the plunger toward the discharge element 6.

The plunger is preferably fabricated from a material that has very low gas permeability, such as high-density polyethylene, high-density polypropylene, and so forth. The break-away section in FIG. 2 illustrates that the plunger 3 may be molded in a form that is generally cup-shaped.

FIGS. 1 and 2 show that the plunger 3 has a plurality of grooves 4 formed in its circumferential surface. The grooves 4 are substantially axially oriented with respect to the plunger 3 and cartridge body 1 when the plunger 3 is inserted therein. The grooves 4 bring about the highly desirable effect of making possible the maintenance of airtightness by the sealant cartridge A of the present invention. This effect is brought about as follows: when the plunger 3 is inserted into the open end of a sealant-filled cartridge body 1, air which would be trapped in the cartridge body between the sealant 5 and a plunger of the prior art, is emitted through the grooves 4 of the plunger 3 of the invention. The sealant itself then fills the grooves 4 after the air discharge. It is important to note that the grooves 4 are preferable axially oriented with respect to the plunger 3 and cartridge body 1 but will still function satisfactorily if slightly oblique thereto.

The number of grooves 4 formed on the plunger's circumferential surface is not specifically restricted, but approximately 1 to 10 is preferred and 4 to 6 is particularly preferred. The grooves 4 are preferably evenly spaced about the circumferential surface of the plunger 3. While the groove depth and width are not specifically restricted with respect to the invention A, a groove depth of 0.01 to 0.5 mm and a groove width of 0.01 to 1.0 mm are preferred for the following reasons.

When the grooves 4 are very deep, they do not adequately fill with sealant 5 and the airtightness of the sealant cartridge A is lessened. When the grooves are very shallow, air will remain at the back end of the cartridge.

The sealant cartridge A of the invention is particularly useful with, inter alia, sealants that cure to elastomer under the action of atmospheric moisture, for example, silicone sealants, polyurethane sealants, polysulfide sealants, silane-modified polyether sealants, etc., and sealants that harden by air-drying such as acrylic sealants, butyl rubber sealants, etc.

Two examples of the sealant cartridge A of the invention are described below.

EXAMPLE 1

In this example, the sealing agent 2 consisted of 60 weight parts polyethylene-based microcrystalline wax (melting point=80° C.) and 40 weight parts high-viscosity polyisobutylene (average molecular weight=1,000). This sealing agent 2 was a thick paste at room temperature. The sealing agent 2 was first coated in a thickness of 0.5 mm and a width of 20 mm on the interior back surface of a cylindrical cartridge body 1. The cylindrical cartridge body 1 was made of polypropylene and carried a discharge nozzle 6 at its tip. A polypropylene plunger 3 having six grooves 4 on its circumferential surface was fabricated. The grooves 4 had a depth of 0.2 mm and a width of 0.5 mm. The cartridge body 1 was filled with a sealant 5 comprising a single-package room-temperature-curable silicone rubber composition. The plunger 3 was then inserted at the open end of the cartridge body 1. No air was trapped at the back end of the cartridge body 1 at this point.

Following the procedure outlined above, 1,000 sealant cartridges A were prepared that were filled with sealant 5. Each of the sealant cartridges A was inspected after its manufacture, and it was found that in no case was air trapped at the back end of a sealant cartridge A. No curing of the sealant 5 at the back end of the sealant cartridge A was observed even when this sealant cartridge A was held for 3 months at 40° C. and 90% relative humidity.

As an additional test, a sealant cartridge A was mounted in a manual caulking gun and part of nozzle 6 (mounted at the tip of sealant cartridge A) was cut off. It was found that the sealant 5 could be smoothly discharged by operation of the caulking gun.

EXAMPLE 2

A sealant cartridge A was again prepared as described in Example 1, except that the sealing agent 2 was composed of 70 weight parts commercial paraffin wax (melting point=70° C.) and 30 weight parts high-viscosity polybutene (average molecular weight=600). This sealing agent 2 was a thick paste at room temperature. The results of testing were identical to those described in connection with Example 1.

While various embodiments of the present invention have been described above, and various features of the invention have been pointed out, these should not be construed as limitations on the scope of the invention. The scope of the present invention is limited only as set forth in the claims below and any equivalents thereof.

What is claimed is:

1. A sealant cartridge for storing and dispensing air-curable sealants comprising:

a tubular cartridge body having an open end and a closed end and defining an interior surface;

said cartridge body being adapted for receiving a sealant therein and being fabricated from a material having low gas permeability;

a discharge element associated with said closed end of the cartridge body;

a sealing agent disposed about the interior surface of said tubular cartridge body, adjacent said open end;

a cylindrically-shaped plunger defining a circumferential surface and adapted for being inserted in said open end of said cartridge body so that the circumferential surface thereof contacts the interior surface of said cartridge body;

said plunger being axially slidable in said cartridge body;

said plunger being fabricated from a material having low gas permeability;

said plunger having at least one substantially axially-oriented groove formed in the circumferential surface thereof;

said at least one substantially axially-oriented groove communicating between the interior of said cartridge body and the exterior thereof when said plunger is inserted in said open end of said cartridge body;

said at least one substantially axially-oriented groove having a depth and width sufficiently large to permit the escape of trapped air from the cartridge body and the extrusion of sealant therethrough when said plunger is inserted in said open end of said cartridge body having sealant disposed therein; and said depth and width of said at least one groove being sufficiently small so that when sealant extruded therethrough is permitted to cure, a substantially air-tight seal is formed thereby.

2. A sealant cartridge in accordance with claim 1 wherein said at least one substantially axially-oriented groove comprises between two and ten grooves.

3. A sealant cartridge in accordance with claim 2 wherein said at least one substantially axially-oriented groove comprises between four and six grooves.

4. A sealant cartridge in accordance with claim 1 wherein said at least one substantially axially-oriented groove comprises a plurality of grooves substantially evenly-spaced about the circumferential surface of said plunger.

5. A sealant cartridge in accordance with claim 1 further comprising said at least one substantially axially-oriented groove having a depth between about 0.01 mm and 0.5 mm and a width between about 0.01 mm and 1.0 mm.

6. A sealant cartridge in accordance with claim 1 wherein said cartridge body and said plunger are fabricated from materials selected from the group consisting of: high-density polyethylene; high density polypropylene; and paper coated with the aforementioned materials or metal foil.

7. A sealant cartridge in accordance with claim 1 wherein said sealing agent is selected from the group consisting of: high viscosity oils; greases; waxes; high viscosity polymers; and mixtures thereof.

8. A sealant cartridge in accordance with claim 7 wherein said sealing agent is a mixture of polyethylene-based microcrystalline wax and high-viscosity polyisobutylene.

9. A sealant cartridge in accordance with claim 7 wherein said sealing agent is a mixture of paraffin wax and high-viscosity polybutene.

* * * * *